US006066031A

United States Patent [19]

Noguchi et al.

[11] Patent Number: 6,066,031

[45] Date of Patent: May 23, 2000

[54] WAFER CHAMFERING METHOD AND APPARATUS

[75] Inventors: Etsuo Noguchi; Kazumi Ikeda, both of Mitaka, Japan

[73] Assignee: Tokyo Seimitsu Co., Ltd., Tokyo, Japan

[21] Appl. No.: 09/037,049

[22] Filed: Mar. 9, 1998

[30] Foreign Application Priority Data

Mar. 10, 1997 [JP] Japan ..... 9-055191

[51] Int. Cl.[7] ..... B24B 1/00

[52] U.S. Cl. ..... 451/44; 451/65; 451/178; 451/254

[58] Field of Search ..... 451/41, 44, 65, 451/178, 246, 254, 398, 358

[56] References Cited

U.S. PATENT DOCUMENTS

| | | | |
|---|---|---|---|
| 5,036,624 | 8/1991 | Steere, Jr. | 51/106 R |
| 5,097,630 | 3/1992 | Maeda et al. | 51/50 R |
| 5,295,331 | 3/1994 | Honda et al. | 51/283 E |
| 5,445,554 | 8/1995 | Hosokawa | 451/11 |
| 5,538,463 | 7/1996 | Hasegawa et al. | 451/254 |
| 5,609,514 | 3/1997 | Yssunaga et al. | 451/65 |
| 5,658,189 | 8/1997 | Kagamida | 451/66 |

FOREIGN PATENT DOCUMENTS

| | | |
|---|---|---|
| 0 354 586 | 2/1990 | European Pat. Off. . |
| 0 552 989 | 7/1993 | European Pat. Off. . |
| 43 31 727 | 3/1994 | Germany . |

*Primary Examiner*—Timothy V. Eley
*Assistant Examiner*—Dung Van Nguyen
*Attorney, Agent, or Firm*—Sixbey, Friedman, Leedom & Ferguson; David S. Safran

[57] ABSTRACT

A wafer to be chamfered is supported in such a manner as to rotate and to move in the X-axis direction and the Y-axis direction which are perpendicular to one another, and a periphery grinding wheel is rotatably placed on the Y-axis. To chamfer a circular part of the wafer, the circular part of the wafer is pressed against the rotating periphery grinding wheel, and then, the wafer is rotated. To chamfer an orientation flat of the wafer, the orientation flat of the wafer is pressed against the rotating periphery grinding wheel, and then, the wafer is fed in the X-axis direction.

4 Claims, 5 Drawing Sheets

48
OR
OF
OR
W
C
θ
CIRCULAR PART CHAMFERING
θ-AXIS MOVEMENT

48
W
θ
CIRCULAR PART CHAMFERING
θ-AXIS MOVEMENT

48
W
Y
X
θ
CORNER CHAMFERING
θ, X, Y-AXES MOVEMENT

48
W
X
ORIENTATION FLAT CHAMFERING
X-AXIS MOVEMENT

48
W
X
ORIENTATION FLAT CHAMFERING
X-AXIS MOVEMENT

48
W
Y
X
θ
CORNER CHAMFERING
θ, X, Y-AXES MOVEMENT

CIRCULAR PART CHAMFERING
θ-AXIS MOVEMENT

CIRCULAR PART CHAMFERING
θ-AXIS MOVEMENT

NOTCH CORNER CHAMFERING
X, Y-AXES MOVEMENT

NOTCH CHAMFERING
X, Y-AXES MOVEMENT

NOTCH CORNER CHAMFERING
X, Y-AXES MOVEMENT

WAFER CHAMFERING METHOD AND APPARATUS

BACKGROUND OF THE INVENTION

1. Field of the Invention

The present invention relates generally to a wafer chamfering method and apparatus, and more particularly to a wafer chamfering method and apparatus for chamfering a wafer in which an orientation flat or a notch is formed at the periphery thereof.

2. Description of Related Art

A conventional wafer chamfering apparatus is constructed in such a way that a wafer table, on which a wafer to be chamfered is mounted, is supported in a manner to move along the Y-axis, and that a periphery grinding wheel is placed on the Y-axis.

To chamfer a circular part of the wafer by the above-mentioned chamfering apparatus, the circular part of the wafer is pressed against the rotating periphery grinding wheel. To chamfer an orientation flat part of the wafer, the orientation flat part of the wafer is pressed against the rotating periphery grinding wheel, and the wafer is slightly rotated and is slightly fed along the Y-axis, so that the orientation flat part can be chamfered.

A notch part of a wafer with the notch is chamfered in the same manner. The notch part of the wafer is pressed against a rotating notch grinding tool, and the wafer is slightly rotated and is slightly fed along the Y-axis, so that the notch part can be chamfered.

In the above-mentioned conventional chamfering method, it is extremely difficult to control the movement and rotation of the wafer, when the orientation flat part or the notch part is chamfered. Thus, the straightness of the orientation flat part or the notch part becomes deteriorated.

SUMMARY OF THE INVENTION

The present invention has been developed in view of the above-described circumstances, and has as its object the provision of a wafer chamfering method and apparatus for accurately chamfering the wafer which has the orientation flat or the notch at the periphery thereof.

To achieve the above-mentioned object, the wafer chamfering method of the present invention for chamfering a periphery of a wafer which has a circular part, an orientation flat part and orientation flat corner parts, wherein the wafer is supported in such a manner as to rotate and to move in an X-axis direction and a Y-axis direction which are perpendicular to one another, a periphery grinding wheel is rotatably placed on the Y-axis, comprises the steps of: chamfering the circular part of the wafer by bringing the circular part into contact with the periphery grinding wheel, which is rotating, and by rotating the wafer; chamfering the orientation flat part of the wafer by bringing the orientation flat part into contact with the periphery grinding wheel, which is rotating, and by feeding the wafer in the X-axis direction; and chamfering one of the orientation flat corner parts of the wafer by bringing the one of the orientation flat corner parts into contact with the periphery grinding wheel, which is rotating, and by rotating the wafer and feeding the wafer in the X-axis direction and the Y-axis direction so that the one of the orientation flat corner parts can always be in contact with the periphery grinding wheel.

According to the present invention, the wafer is supported in such a manner as to rotate and to move in the X-axis direction and the Y-axis direction which are perpendicular to one another, and the periphery grinding wheel is rotatably placed on the Y-axis. To chamfer the circular part of the wafer, the circular part is pressed against the rotating periphery grinding wheel, and then the wafer is rotated. To chamfer the orientation flat part of the wafer, the orientation flat is pressed against the rotating periphery grinding wheel, and then the wafer is fed in the X-axis direction. To chamfer each of the orientation flat corner parts of the wafer, the orientation flat corner part is pressed against the rotating periphery grinding wheel, and then, the wafer is rotated and is fed in the X-axis direction and the Y-axis direction so that the orientation flat corner part can always be in contact with the periphery grinding wheel.

To achieve the above-mentioned object, a wafer chamfering method of the present invention for chamfering a periphery of a wafer which has a circular part, a notch part and notch corner parts, wherein the wafer is supported in such a manner as to rotate and to move in an X-axis direction and a Y-axis direction which are perpendicular to one another, a periphery grinding wheel and a notch grinding tool are rotatably placed on the Y-axis, comprises the steps of: chamfering the circular part of the wafer by bringing the circular part into contact with the periphery grinding wheel, which is rotating, and by rotating the wafer; chamfering the notch part of the wafer by bringing the notch part into contact with the notch grinding tool, which is rotating, and by feeding the wafer in the X-axis direction and the Y-axis direction so that the notch part can always be in contact with the notch grinding tool; and chamfering one of the notch corner parts of the wafer by bringing the one of the notch corner parts into contact with the notch grinding tool, which is rotating, and by feeding the wafer in the X-axis direction and the Y-axis direction so that the one of the notch corner parts can always be in contact with the notch grinding tool.

According to the present invention, the wafer is supported in such a manner as to rotate and to move in the X-axis direction and the Y-axis direction which are perpendicular to one another, and the periphery grinding wheel and the notch grinding tool are rotatably placed on the Y-axis. To chamfer the circular part of the wafer, the circular part is pressed against the rotating periphery grinding wheel, and then the wafer is rotated. To chamfer the notch part of the wafer, the notch part is pressed against the rotating notch grinding tool, and then the wafer is fed in the X-axis direction and the Y-axis direction so that the notch part can always be in contact with the notch grinding tool. To chamfer each of the notch corner parts of the wafer, the notch corner part is pressed against the rotating notch grinding tool, and then, the wafer is fed in the X-axis direction and the Y-axis direction so that the notch corner part can always be in contact with the notch grinding tool.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

This invention will be described in further detail by way of example with reference to the accompanying drawings.

Figure 1:
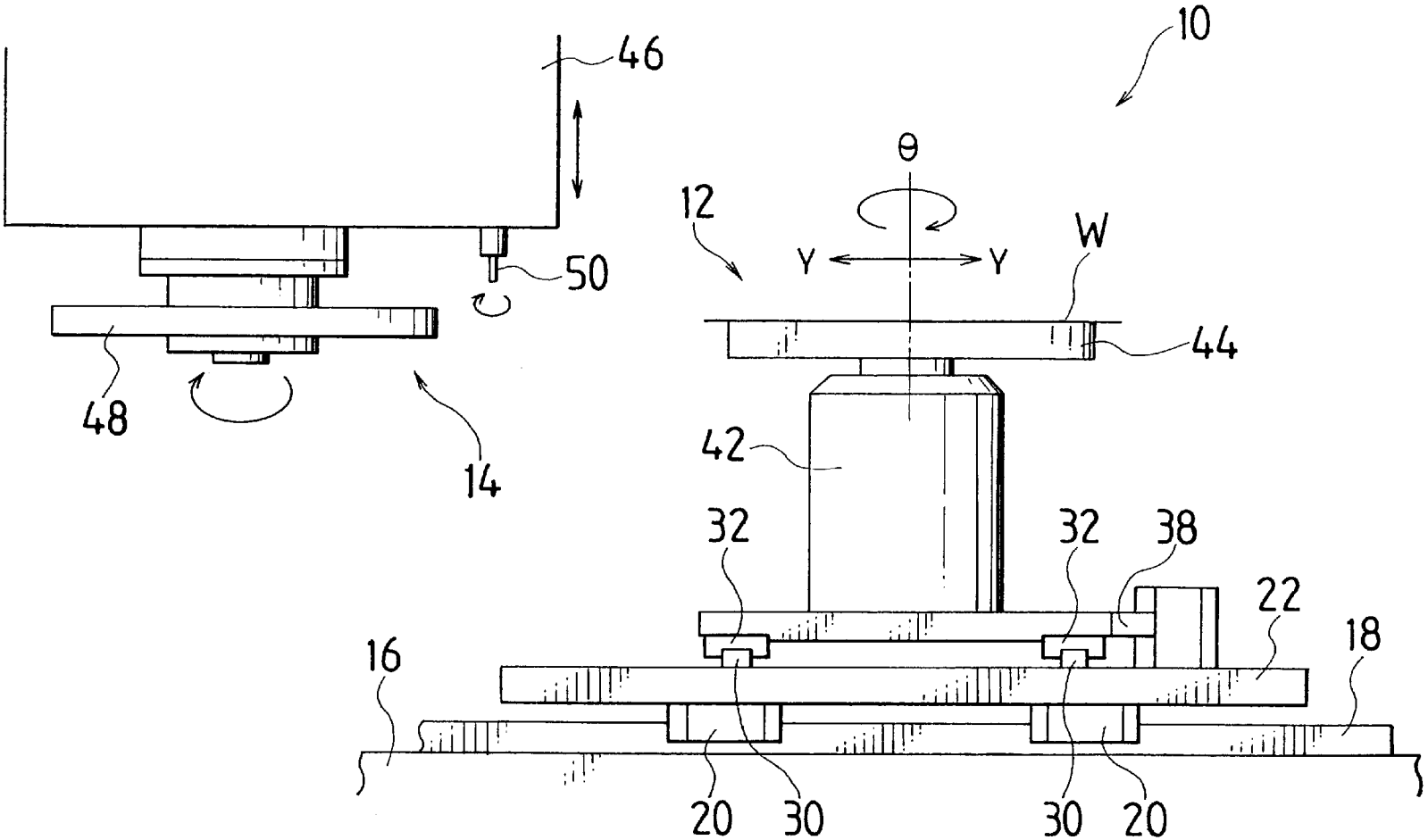
FIG. 1 is a side view illustrating an embodiment of a wafer chamfering apparatus according to the present invention.

FIG. 1 is a side view illustrating an embodiment of a wafer chamfering apparatus according to the present invention. As shown in FIG. 1, the wafer chamfering apparatus 10 comprises a wafer feeding apparatus 12 and a grinding tool apparatus 14.

Figure 2:
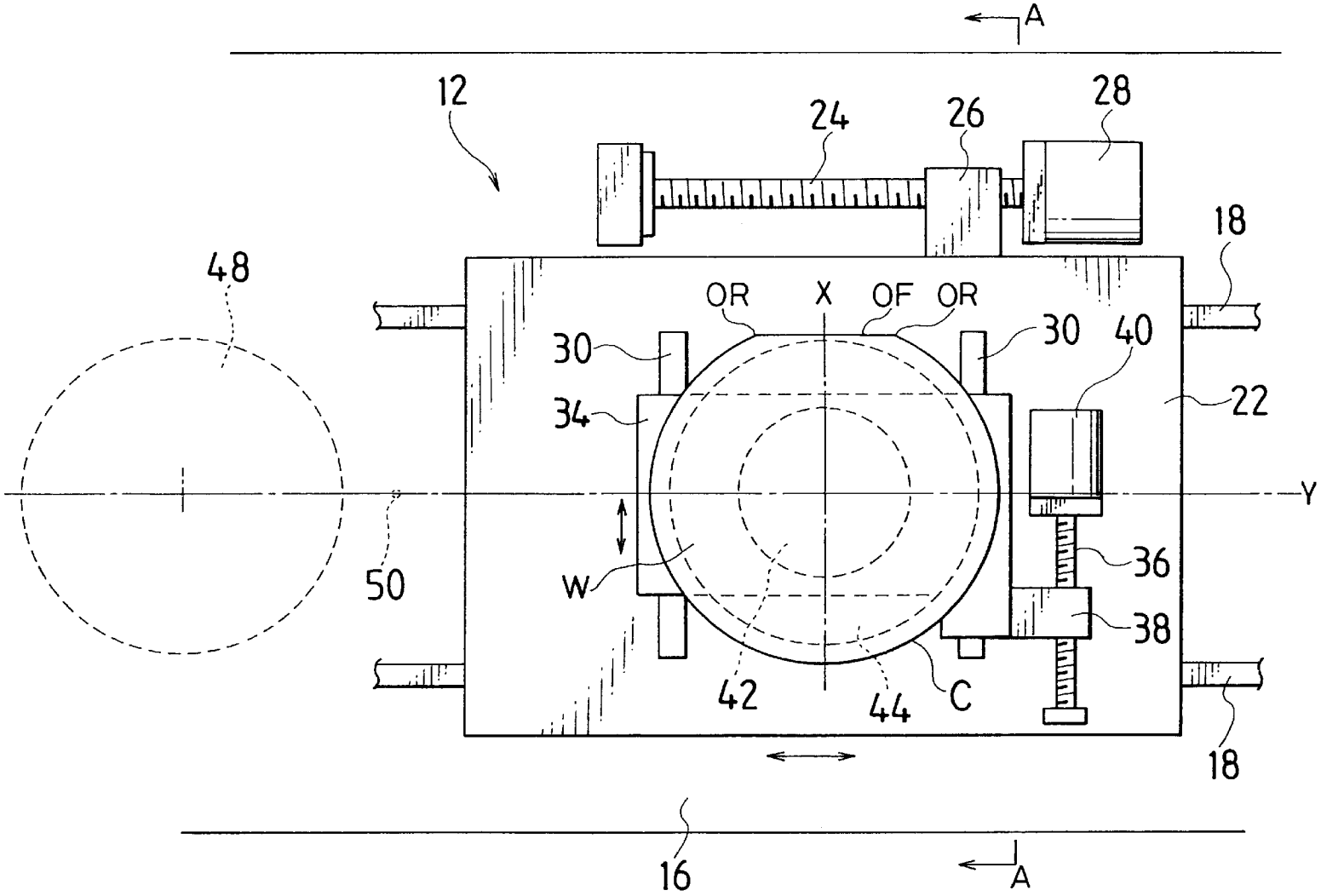
FIG. 2 is a plan view illustrating a wafer feeding apparatus.
Figure 3:
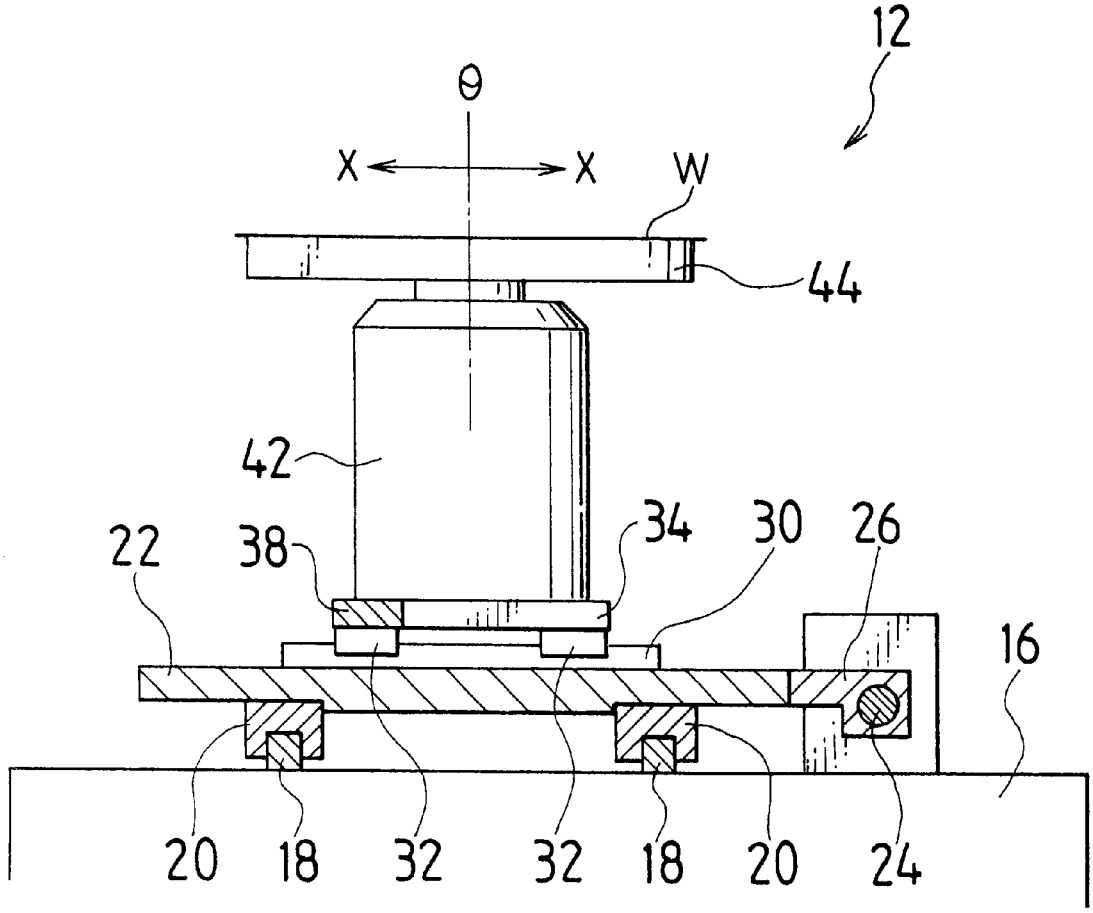
FIG. 3 is a view taken along a line A—A of FIG. 2.

A description will be given of the construction of the wafer feeding apparatus 12. As shown in FIGS. 1–3, a pair of guide rails 18 is provided on a horizontally-arranged base 16. A Y-axis table 22 is slidably supported on the guide rails 18 via sliders 20. The Y-axis table 22 is driven by a feed screw mechanism, which is constructed as described below.

As shown in FIG. 2, a ball screw 24 is provided in parallel with the guide rails 18 on the base 16. The ball screw 24 is engaged with a nut member 26, which is secured to the Y-axis table 22. One end of the ball screw 24 connects to a motor 28, which is rotatable forward and backward and is driven to rotate the ball screw 24. When the ball screw 24 rotates, the nut member 26 moves along the ball screw 24, and thereby, the Y-axis table 22, which is connected to the nut member 26, slides along the guide rails 18. A direction in which the Y-axis table 22 slides will hereafter be referred to as a Y-axis direction, and a straight line which is parallel with the Y-direction and goes through the center of the Y-axis table 22 will be referred to as the Y-axis.

A pair of guide rails 30 is provided on the Y-axis table 22 in a direction perpendicular to the Y-axis direction. An X-axis table 34 is slidably supported on the guide rails 30 via sliders 32. The X-axis table 34 is driven by a feed screw mechanism in the same manner as the Y-axis table 22, and the feed screw mechanism is constructed as described below.

As shown in FIG. 2, a ball screw 36 is provided in parallel with the guide rails 30 on the Y-axis table 22. The ball screw 36 is engaged with a nut member 38, which is secured to the X-axis table 34. One end of the ball screw 36 connects to a motor 40, which is rotatable forward and backward and is driven to rotate the ball screw 36. When the ball screw 36 rotates, the nut member 38 moves along the ball screw 36, and thereby, the X-axis table 34, which is connected to the nut member 34, slides along the guide rails 30. A direction in which the X-axis table 34 slides will hereafter be referred to as an X-axis direction, and a straight line which is parallel with the X-axis direction and goes through the center of the X-axis table 34 will be referred to as the X-axis.

A wafer table support 42 is centered on the X-axis table 34. A wafer table 44 is rotatably supported on the wafer table support 42, and the wafer table 44 is rotated by a motor (not shown), which is built in the wafer table support 42. A wafer W to be chamfered is held on the wafer table 44 with vacuum. A straight line which is perpendicular to the wafer table 44 and goes through the rotational center of the wafer table 44 will be referred to as the θ-axis.

Since the wafer feeding apparatus 12 is constructed as described above, the wafer W held on the wafer table 44 can be rotated about the θ-axis and can be fed in the X-axis direction and the Y-axis direction.

A description will be given of the construction of the grinding tool apparatus 14. As shown in FIG. 1, the grinding tool apparatus 14 has a grinding tool support 46. The grinding tool support 46 is slidably supported on a column (not shown), which vertically stands on the base 16, and a drive (not shown) drives the grinding tool support 46 so that the grinding tool support 46 moves up and down along the column. A periphery grinding wheel 48 and a notch grinding tool 50 are provided at the bottom of the grinding tool support 46. The periphery grinding wheel 48 and the notch grinding tool 50 are respectively rotated by motors (not shown), which are built in the grinding tool support 46. The periphery grinding wheel 48 and the notch grinding tool 50 are located on the Y-axis as shown in FIG. 2, and the notch grinding tool 50 is located at a predetermined height above the periphery grinding wheel 48 as shown in FIG. 1.

The grinding tool apparatus 14 is constructed as described above, and the periphery of the wafer W is chamfered in such a way that the periphery of the wafer W is pressed against the rotating periphery grinding wheel 48 or the rotating notch grinding tool 50 of the grinding tool apparatus 14.

The wafer chamfering apparatus 10 of the present invention is constructed as described above, and a controller (not shown) controls the wafer chamfering apparatus 10.

A description will be given of the operation of the wafer chamfering apparatus 10 according to the present invention, which is constructed in the above-mentioned manner. Since the wafer chamfering apparatus 10 is able to chamfer both the wafer W with an orientation flat and the wafer W with a notch, a description will be given first of the method for chamfering the wafer W with the orientation flat, and then a description will be given of the method for chamfering the wafer W with the notch.

Figure 4:
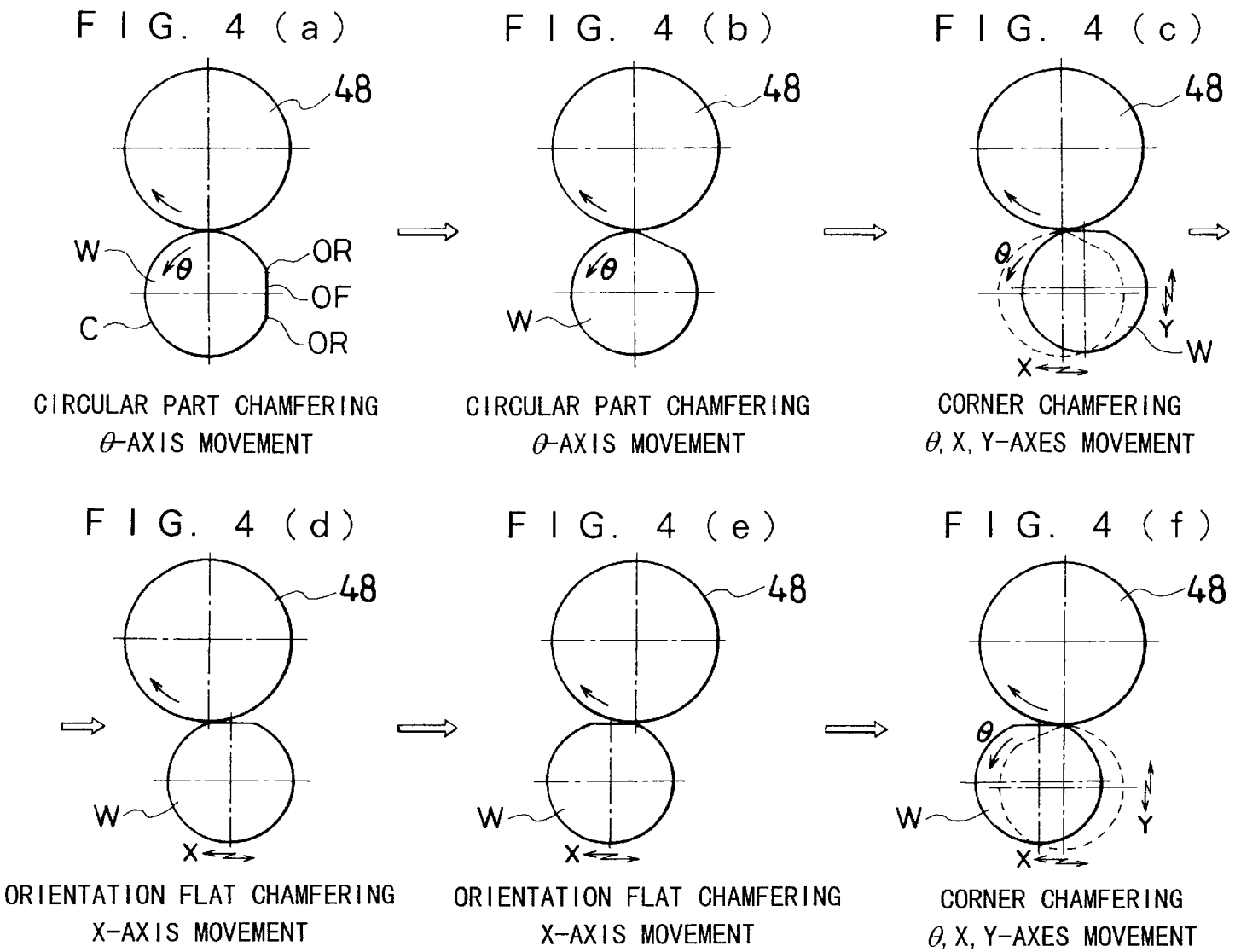
FIGS. 4(*a*), 4(*b*), 4(*c*), 4(*d*), 4(*e*) and 4(*f*) are views of assistance in explaining a method of chamfering a wafer with an orientation flat.

A description will hereunder be given of the method for chamfering the wafer W with the orientation flat with reference to FIGS. 4(*a*)–4(*f*), which describe the procedure.

First, the wafer W is set on the wafer chamfering apparatus 10. Specifically, the wafer W is positioned on the wafer table 44, and the wafer W is held on the wafer table 44 with vacuum.

The wafer W is placed so that the center thereof can be positioned on the θ-axis of the wafer table 44, and that an orientation flat OF thereof can be parallel to the Y-axis (see FIG. 4(*a*)). This state will be referred to as an initial state, where the center of the wafer W is positioned on the Y-axis and at a predetermined distance away from the axis of the periphery grinding wheel 48.

On the other hand, in the grinding tool apparatus 14, the grinding tool support 46 moves up or down so as to position the periphery grinding wheel 48 at a predetermined machining position.

On completion of the above-mentioned initialization, the wafer chamfering apparatus 10 starts chamfering the wafer W.

First, the periphery grinding wheel 48 is rotated, and the wafer W is fed in the Y-axis direction to the periphery grinding wheel 48 at the same time. When the wafer W moves by a predetermined distance, a circular part C of the wafer W meets the rotating periphery grinding wheel 48, and the wafer W stops moving.

As shown in FIG. 4(*a*), when the circular part C of the wafer W meets the periphery grinding wheel 48, the wafer W starts rotating about the θ-axis by a predetermined angle. Thereby, the circular part C of the wafer W is chamfered by the rotating periphery grinding wheel 48.

As shown in FIG. 4(*b*), when the wafer W rotates by the predetermined angle, a point of contact between the wafer W and the periphery grinding wheel 48 reaches an orientation flat corner OR of the wafer W. In this state, only the rotation of the wafer W cannot bring the orientation flat corner OR into contact with the periphery grinding wheel 48. For this reason, the orientation flat corner OR is chamfered by controlling movement of the wafer W as described below.

When the point of contact reaches the orientation flat corner OR of the wafer W as represented with a broken line in FIG. 4(*c*), the wafer W is rotated about the θ-axis and is fed in the X-axis direction and the Y-axis direction. The wafer W moves so that the orientation flat corner OR can always be in contact with the periphery grinding wheel 48. Thus, the orientation flat corner OR of the wafer W is chamfered by the periphery grinding wheel 48.

Then, the orientation flat OF of the wafer W, of which movement is controlled as stated above, finally becomes parallel to the X-axis as represented with a solid line in FIG. 4(*c*), and the chamfering of the orientation flat corner OR is completed. In this state, the periphery grinding wheel 48 is in contact with the orientation flat OF of the wafer W. Then, the orientation flat OF is chamfered subsequently.

As shown in FIG. 4(*d*), the orientation flat OF is chamfered by feeding the wafer W in the X-axis direction. That is, the wafer W moves in parallel with the orientation flat OF while the orientation flat OF being in contact with the periphery grinding wheel 48. Thereby, the orientation flat OF is chamfered by the periphery grinding wheel 48.

The wafer W is fed in the X-axis direction until the point of contact between the wafer W and the periphery grinding wheel 48 reaches the other end of the orientation flat OF, or the other orientation flat corner OR as shown in FIG. 4(*e*). When the point of contact reaches the orientation corner OR, the orientation flat corner OR is chamfered subsequently.

Specifically, when the point of contact reaches the orientation flat corner OR of the wafer W as represented with a solid line in FIG. 4(*f*), the wafer W is rotated about the θ-axis and is fed in the X-axis direction and the Y-axis direction. The wafer W moves so that the orientation flat corner OR can always be in contact with the periphery grinding wheel 48. Thus, the orientation flat corner OR of the wafer W is chamfered by the periphery grinding wheel 48.

Then, the center of the wafer W, of which movement is controlled as stated above, is finally positioned on the Y-axis as represented with a broken line in FIG. 4(*f*), and the chamfering of the orientation flat corner OR is completed. In this state, the periphery grinding wheel 48 is in contact with the circular part C of the wafer W. Thereafter, the wafer W is rotated about the θ-axis to chamfer the circular part C subsequently, and then, the wafer W returns to the state where the chamfering is started, that is, the state shown in FIG. 4(*a*). The chamfering of the whole periphery of the wafer W is completed by repeating the above-mentioned series of processes a plurality of times.

When the chamfering of the wafer W is completed, the wafer W stops in the state where the chamfering started, that is, the state shown in FIG. 4(*a*). Then, the wafer W moves in the Y-axis direction so that it becomes farther away from the periphery grinding wheel 48, and the wafer W returns to the initial state. The wafer W is picked from the wafer table 44, and the machining is completed.

As stated above, according to the wafer chamfering method and apparatus in this embodiment, when the orientation flat OF of the wafer W is chamfered, the wafer W is fed straight in parallel with the orientation flat OF. Thus, it is possible to easily chamfer the orientation flat OF with high straightness. When each of the orientation flat corners OR of the wafer W is chamfered, the wafer W is moved so that the orientation flat corner OR can always be in contact with the periphery grinding wheel 48. Thus, it is possible to easily chamfer the orientation flat corners OR with high accuracy. Moreover, it is possible to control movement of the wafer W in a simple way.

In this embodiment, the whole periphery of the wafer W is sequentially chamfered, but each part of the periphery of the wafer W may be chamfered separately. Specifically, only the circular part C of the wafer W may be chamfered first, then the orientation flat F may be chamfered, and finally the orientation flat corners OR may be chamfered.

The machining order should not be restricted to the above-mentioned order. For instance, the orientation flat OF may be chamfered first, then the orientation flat corners OR may be chamfered, and finally the circular part C may be chamfered.

A description will be given of the method for chamfering the wafer W with the notch with reference to FIGS. 5(*a*)–5(*e*), which describe the procedure.

First, the wafer W is set on the wafer chamfering apparatus 10. Specifically, the wafer W is positioned on the wafer table 44, and the wafer W is held on the wafer table 44 with vacuum.

Figure 5:
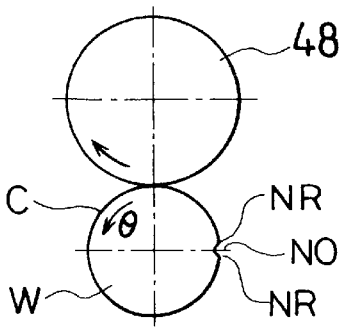
FIGS. 5(*a*), 5(*b*), 5(*c*), 5(*d*) and 5(*e*) are views of assistance in explaining a method of chamfering a wafer with a notch.
Figure 5:
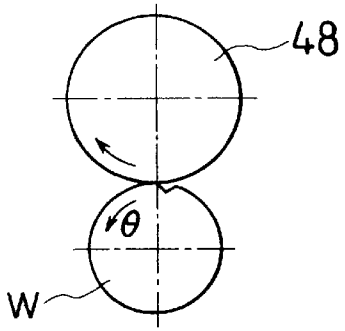
Figure 5:
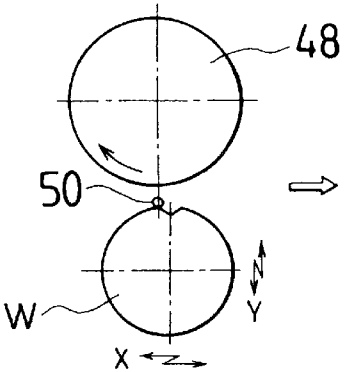
Figure 5:
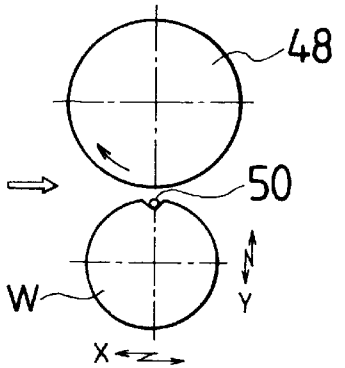
Figure 5:
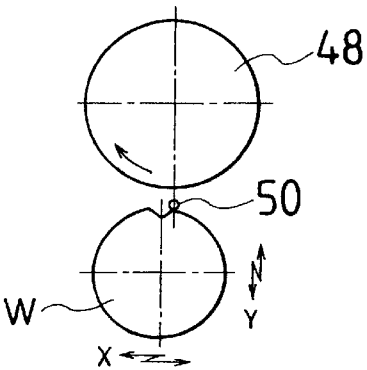

The wafer W is placed so that the center thereof can be positioned on the θ-axis of the wafer table 44, and that a notch NO thereof can be positioned on the X-axis (see FIG. 5(*a*)). This state will be referred to as an initial state, where the center of the wafer W is positioned on the Y-axis and at a predetermined distance away from the axis of the periphery grinding wheel 48.

On the other hand, in the grinding tool apparatus 14, the grinding tool support 46 moves up or down so as to position the periphery grinding wheel 48 at a predetermined machining position.

On completion of the above-mentioned initialization, the wafer chamfering apparatus 10 starts chamfering the wafer W.

First, the periphery grinding wheel 48 is rotated, and the wafer W is fed in the Y-axis direction to the periphery grinding wheel 48 at the same time. When the wafer W moves by a predetermined distance, a circular part C of the wafer W meets the rotating periphery grinding wheel 48, and the wafer W stops moving.

As shown in FIG. 5(*a*), when the circular part C of the wafer W meets the periphery grinding wheel 48, the wafer W starts rotating. Thereby, the circular part C of the wafer W is chamfered by the rotating periphery grinding wheel 48 as shown in FIG. 5(*b*).

After the wafer W rotates a predetermined number of times, the chamfering of the circular part C of the wafer W is completed. Then, the wafer W stops rotating, and returns to the initial state. Thereafter, the wafer chamfering apparatus 10 starts chamfering the notch NO of the wafer W.

To chamfer the notch NO, the wafer W moves in the X-axis direction by a predetermined distance from the initial state until it reaches a predetermined machining position (see FIG. 5(*c*)). On the other hand, in the grinding tool apparatus 14, the grinding tool support 46 moves down by a predetermined distance so that the notch grinding tool 50 can be positioned at a predetermined machining position. Then, the notch grinding tool 50 is rotated, and the wafer W is fed in the Y-axis direction at the same time. When the wafer W moves by a predetermined distance, a notch corner NR of the wafer W meets the rotating notch grinding tool 50, and the wafer W stops moving.

As shown in FIG. 5(*c*), when the notch corner NR of the wafer W meets the notch grinding tool 50, the wafer W is fed in the X-axis direction and the Y-axis direction so that the notch corner NR can be chamfered. In other words, the wafer W moves according to the shape of the notch corner NR so that the notch corner NR can always be in contact with the notch grinding tool 50. Thereby, the notch corner NR of the wafer W is chamfered by the notch grinding tool 50.

After the notch corner NR is chamfered, the wafer W is subsequently fed in the X-axis direction and the Y-axis direction so that the notch NO can be chamfered. Specifically, as shown in FIG. 5(*d*), the wafer W is fed so that the notch NO can always be in contact with the notch grinding tool 50. In FIG. 5(*d*), the notch NO is V-shaped for example, and the wafer W moves in a manner to describe V according to the shape of the notch NO. Thereby, the notch NO of the wafer W is chamfered by the notch grinding tool 50.

When a point of contact between the wafer W and the notch grinding tool 50 reaches the other notch corner NR at the other side of the notch NO, the notch corner NR is subsequently chamfered as shown in FIG. 5(*e*). Specifically, the wafer W is fed in the X-axis direction and the Y-axis direction so that the notch corner NR can always be in contact with the notch grinding tool 50. Thereby, the notch corner NR of the wafer W is chamfered by the notch grinding tool 50.

After the notch corner NR at the other side is chamfered, the wafer W stops moving. Then, the notch NO and the notch corners NR are chamfered in the reverse direction in the same manner as described above. Specifically, the notch grinding tool 50 moves relatively to the wafer W from the notch corner NR at the other side to the notch NO, and it returns to the state where the chamfering of the notch NO started, that is, the state shown in FIG. 5(*c*).

The chamfering of the notch NO and the notch corners NR is completed by repeating the above-mentioned series of processes a required number of times.

When the chamfering of the notch NO and the notch corners NR is completed, the wafer W stops in the state where the chamfering of the notch NO started, that is, the state shown in FIG. 5(*c*). Then, the wafer W moves in the Y-axis direction so that it becomes farther away from the notch grinding tool 50, and the wafer W returns to the initial state. The wafer W is picked from the table 44, and the machining is completed.

As stated above, according to the wafer chamfering method and apparatus in this embodiment, when the notch NO of the wafer W is chamfered, the wafer W is fed so that the notch grinding tool 50 can always be in contact with the notch NO. Thus, it is possible to easily chamfer the notch NO with high accuracy. When each of the notch corners NR of the wafer W is chamfered, the wafer W is fed so that the notch grinding tool 50 can always be in contact with the notch corner NR. Thus, it is possible to easily chamfer the notch corners NR with high accuracy. Moreover, it is possible to control movement of the wafer W in a simple way.

In this embodiment, the circular part C of the wafer W is chamfered first, and then the notch NO and the notch corners NR are chamfered. The machining order, however, should not be restricted to this: for example, the notch NO and the notch corners NR may be chamfered first, and then the circular part C may be chamfered.

As set forth hereinabove, according to the present invention, the movement of the wafer is controlled by rotating the wafer on the rotational axis and feeding the wafer along the two axes which are perpendicular to the rotational axis and are perpendicular to one another. Thus, it is possible to accurately chamfer the whole periphery of the wafer which has the orientation flat or the notch at the periphery thereof.

It should be understood, however, that there is no intention to limit the invention to the specific forms disclosed, but on the contrary, the invention is to cover all modifications, alternate constructions and equivalents falling within the spirit and scope of the invention as expressed in the appended claims.

We claim:

1. A wafer chamfering method for chamfering a periphery of a wafer which has a circular part, an orientation flat part and orientation flat corner parts, wherein the wafer is supported in such a manner as to rotate and to move in an X-axis direction and a Y-axis direction which are perpendicular to one another in a horizontal plane, a periphery grinding wheel is rotatable about a vertical axis which intersects the Y-axis, said wafer chamfering method comprising the steps of:

chamfering the circular part of the wafer by bringing the circular part along the Y-axis into contact with said periphery grinding wheel which is rotating, and by rotating the wafer;

chamfering the orientation flat part of the wafer by bringing the orientation flat part along the Y-axis into contact with said periphery grinding wheel which is rotating, and by feeding the wafer in the X-axis direction; and chamfering one of the orientation flat corner parts of the wafer by bringing the one of the orientation flat corner parts into contact with said periphery grinding wheel, which is rotating, and by rotating the wafer and feeding the wafer in the X-axis direction and the Y-axis direction so that the one of the orientation flat corner parts can always be in contact with said periphery grinding wheel.

2. A wafer chamfering apparatus for chamfering a periphery of a wafer which has a circular part, an orientation flat part and orientation flat corner parts, said wafer chamfering apparatus comprising:

a wafer table support which is capable of moving in an X-axis direction and a Y-axis direction which are perpendicular to one another in a horizontal plane;

a wafer table which is rotatably placed on said wafer table support and holds the wafer;

a grinding tool support which is positioned on the Y-axis and is capable of moving up and down perpendicular to said Y-axis;

a periphery grinding wheel which is rotatably placed on said grinding tool support;

a controller which controls feeding of said wafer table support in the X-axis direction and the Y-axis direction, rotation of said wafer table, up-and-down movement of said grinding tool support, and rotation of said periphery grinding wheel;

wherein said controller brings the circular part of the wafer along the Y-axis into contact with said periphery grinding wheel, which is rotating, and rotates the wafer, thereby chamfering the circular part;

said controller brings the orientation flat part of the wafer along the Y-axis into contact with said periphery grinding wheel, which is rotating, and feeds the wafer in the X-axis direction, thereby chamfering the orientation flat part; and said controller brings one of the orientation flat corner parts of the wafer into contact with said periphery grinding wheel, which is rotating, and rotates the wafer and feeds the wafer in the X-axis direction and the Y-axis direction so that the one of the orientation flat corner parts can always be in contact with said periphery grinding wheel, thereby chamfering the one of the orientation flat corner parts.

3. A wafer chamfering method for chamfering a periphery of a wafer which has a circular part, a notch part and notch corner parts, wherein the wafer is supported in such a manner as to rotate and to move in an X-axis direction and a Y-axis direction which are perpendicular to one another in a horizontal plane, a periphery grinding wheel and a notch grinding tool are rotatable about a vertical axis which intersects the Y-axis, said wafer chamfering method comprising the steps of:

chamfering the circular part of the wafer by bringing the circular part along the Y-axis into contact with said periphery grinding wheel, which is rotating, and by rotating the wafer;

chamfering the notch part of the wafer by bringing the notch part along the Y-axis into contact with said notch grinding tool, which is rotating, and by feeding the wafer in the X-axis direction and the Y-axis direction so that the notch part can always be in contact with said notch grinding tool; and chamfering one of the notch corner parts of the wafer by bringing the one of the notch corner parts alone the Y-axis into contact with said notch grinding tool, which is rotating, and by feeding the wafer in the X-axis direction and the Y-axis direction so that the one of the notch corner parts can always be in contact with said notch grinding tool.

4. A wafer chamfering apparatus for chamfering a periphery of a wafer which has a circular part, a notch part and notch corner parts, said wafer chamfering apparatus comprising:

a wafer table support which is capable of moving in an X-axis direction and a Y-axis direction which are perpendicular to one another in a horizontal plane;

a wafer table which is rotatably placed on said wafer table support and holds the wafer;

a grinding tool support which is positioned on the Y-axis and is capable of moving up and down perpendicular to said Y-axis;

a periphery grinding wheel which is rotatably placed on said grinding tool support;

a notch grinding tool which is rotatably placed on said grinding tool support;

a controller which controls feeding of said wafer table support in the X-axis direction and the Y-axis direction, rotation of said wafer table, up-and-down movement of said grinding tool support, rotation of said periphery grinding wheel, and rotation of said notch grinding tool;

wherein said controller brings the circular part of the wafer along the Y-axis into contact with said periphery grinding wheel, which is rotating, and rotates the wafer, thereby chamfering the circular part;

said controller bring the notch part of the wafer along the Y-axis into contact with said notch grinding tool, which is rotating, and feeds the wafer in the X-axis direction and the Y-axis direction so that the notch part can always be in contact with said notch grinding tool, thereby chamfering the notch part; and said controller brings one of the notch corner parts of the wafer along the Y-axis into contact with said notch grinding tool, which is rotating, and feeds the wafer in the X-axis direction and the Y-axis direction so that the one of the notch corner parts can always be in contact with said notch grinding tool, thereby chamfering the one of the notch corner parts.

* * * * *